US006346050B1

(12) United States Patent
Larson

(10) Patent No.: US 6,346,050 B1
(45) Date of Patent: Feb. 12, 2002

(54) GOLF TRAINING DEVICE AND METHOD

(76) Inventor: Blair Larson, 3100 W. Shannon Dr., Flagstaff, AZ (US) 86001

( * ) Notice: Subject to any disclaimer, the term of this patent is extended or adjusted under 35 U.S.C. 154(b) by 0 days.

(21) Appl. No.: 09/492,019

(22) Filed: Jan. 26, 2000

(51) Int. Cl.[7] ..... A63B 69/36

(52) U.S. Cl. ..... 473/270; 473/218; 473/219; 473/266; 473/409

(58) Field of Search ..... 473/218, 219, 473/231, 238, 266, 270, 409

(56) References Cited

U.S. PATENT DOCUMENTS

| | | | | | |
|---|---|---|---|---|---|
| 3,166,327 | A | * | 1/1965 | Champion | 473/218 |
| 3,580,584 | A | | 5/1971 | Trosko | |
| 3,679,206 | A | | 7/1972 | Shambaugh | |
| 4,915,387 | A | * | 4/1990 | Baxstrom | 473/218 |
| 5,163,686 | A | * | 11/1992 | Bergman | 473/218 |
| 5,171,017 | A | * | 12/1992 | Betancourt | 473/218 |
| 5,415,407 | A | | 5/1995 | Beatty | |
| 5,478,082 | A | * | 12/1995 | De Knight et al. | 473/218 |
| 5,938,539 | A | | 8/1999 | Hamilton | |
| 5,944,613 | A | * | 8/1999 | Dubois | 473/218 |
| 6,077,169 | A | * | 6/2000 | Florian | 473/270 X |
| 6,106,408 | A | * | 8/2000 | Roman | 473/266 |
| 6,171,201 | B1 | * | 1/2001 | Tiller | 473/266 X |

FOREIGN PATENT DOCUMENTS

| | | | | |
|---|---|---|---|---|
| GB | 2087241 | * | 5/1982 | 273/187 R |
| GB | 2254008 | * | 9/1992 | 273/187 R |

OTHER PUBLICATIONS

1999Vision Golf, LLC/internet web site information/copyright 1998/created by Scott Baker.

* cited by examiner

*Primary Examiner*—Raleigh W. Chiu
(74) *Attorney, Agent, or Firm*—Jeffrey Weiss; Harry M. Weiss; Weiss & Moy, P.C.

(57) ABSTRACT

A golf swing training device and method that is designed to improve a golfer's swing plane, alignment, balance, swing tempo and ball placement skills. The device includes an alignment shaft to act as an aid in aligning the golfer relative to the target and to develop proper balance and ball placement skills, and a template shaft and template for helping a golfer to swing at a desired angle and thus to improve the plane of the golfer's swing.

21 Claims, 2 Drawing Sheets

GOLF TRAINING DEVICE AND METHOD

BACKGROUND OF THE INVENTION

1. Field of the Invention

This invention relates to the field of golf, and more particularly, to a device and method for improving a golfer's swing.

2. Description of the Related Art

It is no secret that the soundness of the golfer's swing is the key to a successful golf shot. The elements that make up a successful golf swing include proper swing plane, alignment, balance, tempo, and ball placement. A golfer's improvement of one or more of these elements should translate into a more successful golf swing. A golfer's improvement of each of these elements should yield significant improvements in the golfer's swing.

With respect to swing plane, it is generally desired that the club head travel from inside of the ball to the outside during the swing, to impart the desired trajectory. An outside-to-in swing plane can cause a golfer to slice the ball. The concept of alignment—i.e., the orientation of the golfer's body in relation to the target—is also critical to good shot-making. When a golfer aims too far to the left of the target, the golfer may inadvertently open the club face excessively, resulting in a severe hook or slice.

The concept of balance is related to the golfer's stance. A stance that is too wide tends to produce thinned or knuckle-ball type shots, while an excessively narrow stance tends to lead to a swaying motion on the downswing, resulting in mis-hits. The proper stance has a golfer oriented so that his or her feet, knees, hips and shoulders are in a vertical line on top of each other.

Proper swing tempo or rhythm is also an essential ingredient of a successful golf shot. A back swing that is too fast can lead to a poor swing. Finally, the ball must be properly placed for the golfer to have success. The proper location depends on the particular club used, with the ball being placed more or less forward in the golfer's stance, as appropriate.

A need exists for a golf training device and method that addresses some, and preferably all, of the elements of swing plane, alignment, balance, tempo and ball placement. The present invention fulfills these needs and provides other related advantages.

SUMMARY OF THE INVENTION

It is an object of the present invention to provide a golf training device and method for improving a golfer's skills relating to proper swing plane, alignment, balance, tempo and ball placement.

BRIEF DESCRIPTION OF THE PREFERRED EMBODIMENTS

In accordance with one embodiment of the present invention a golf swing training device is disclosed. The device comprises, in combination: an alignment shaft; wherein the alignment shaft contains indicators showing the proper positioning of a user's shoulders for striking a golf ball; wherein the alignment shaft further contains at least one indicator showing the proper positioning of the golf ball for striking; a template dimensioned to positioned parallel to the alignment shaft; wherein the template comprises at least one opening therein at a desired club angle; and a template shaft dimensioned to be inserted into the opening and to extend in the direction of the user so as to permit the user to orient a golf club below and parallel the template shaft at the desired club angle and with a head of the golf club proximate the golf ball.

In accordance with another embodiment of the present invention, a method for improving a golf swing is disclosed. The method comprises the steps of: providing an alignment shaft; wherein the alignment shaft contains two shoulder position indicators showing the proper positioning of a user's shoulders for striking a golf ball; wherein the alignment shaft further contains at least one golf ball position indicator showing the proper positioning of the golf ball for striking; positioning the alignment shaft in front of the user so that the user is facing the alignment shaft and so that a lateral portion of each of the two shoulders of the user is located opposite one of the shoulder position indicators; providing a template; wherein the template comprises at least one opening therein at a desired club angle; positioning the template parallel to the alignment shaft so that the user is located on one side of the alignment shaft and the template is located on another side of the alignment shaft; providing a template shaft dimensioned to be inserted into the opening and to extend in the direction of the user so as to permit the user to orient a golf club below and parallel the template shaft at the desired club angle and with a head of the golf club proximate the golf ball; inserting the template shaft into the opening; positioning the golf ball proximate the golf ball position indicator; positioning a head of the golf club proximate the golf ball so that a shaft of the golf club is at the desired club angle; and swinging the golf club so that the shaft passes below the template shaft while maintaining the desired club angle.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
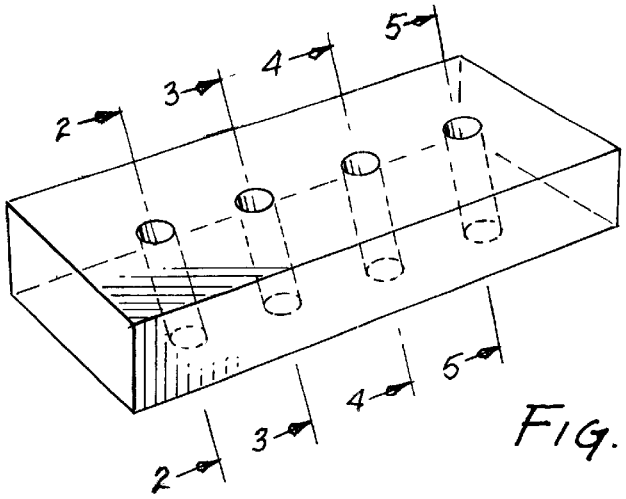
FIG. 1 is a perspective view of a template having four angled openings therethrough.
Figure 2:
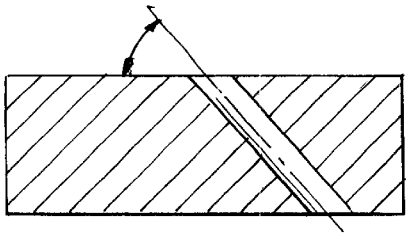
FIG. 2 is a cross-sectional view of the template of FIG. 1, along line 2—2.
Figure 3:
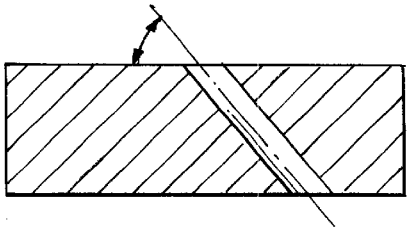
FIG. 3 is a cross-sectional view of the template of FIG. 1, along line 3—3.
Figure 4:
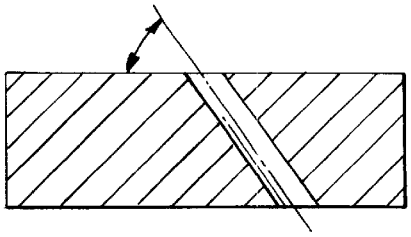
FIG. 4 is a cross-sectional view of the template of FIG. 1, along line 4—4.
Figure 5:
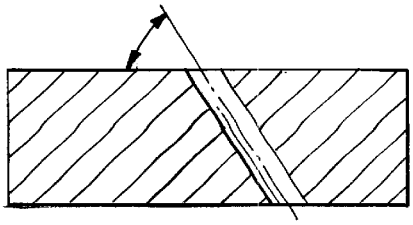
FIG. 5 is a cross-sectional view of the template of FIG. 1, along line 5—5.
Figure 6:
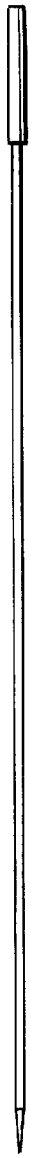
FIG. 6 is a side view of a template shaft.
Figure 7:
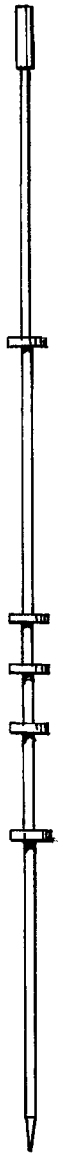
FIG. 7 is a side view of an alignment shaft.
Figure 8:
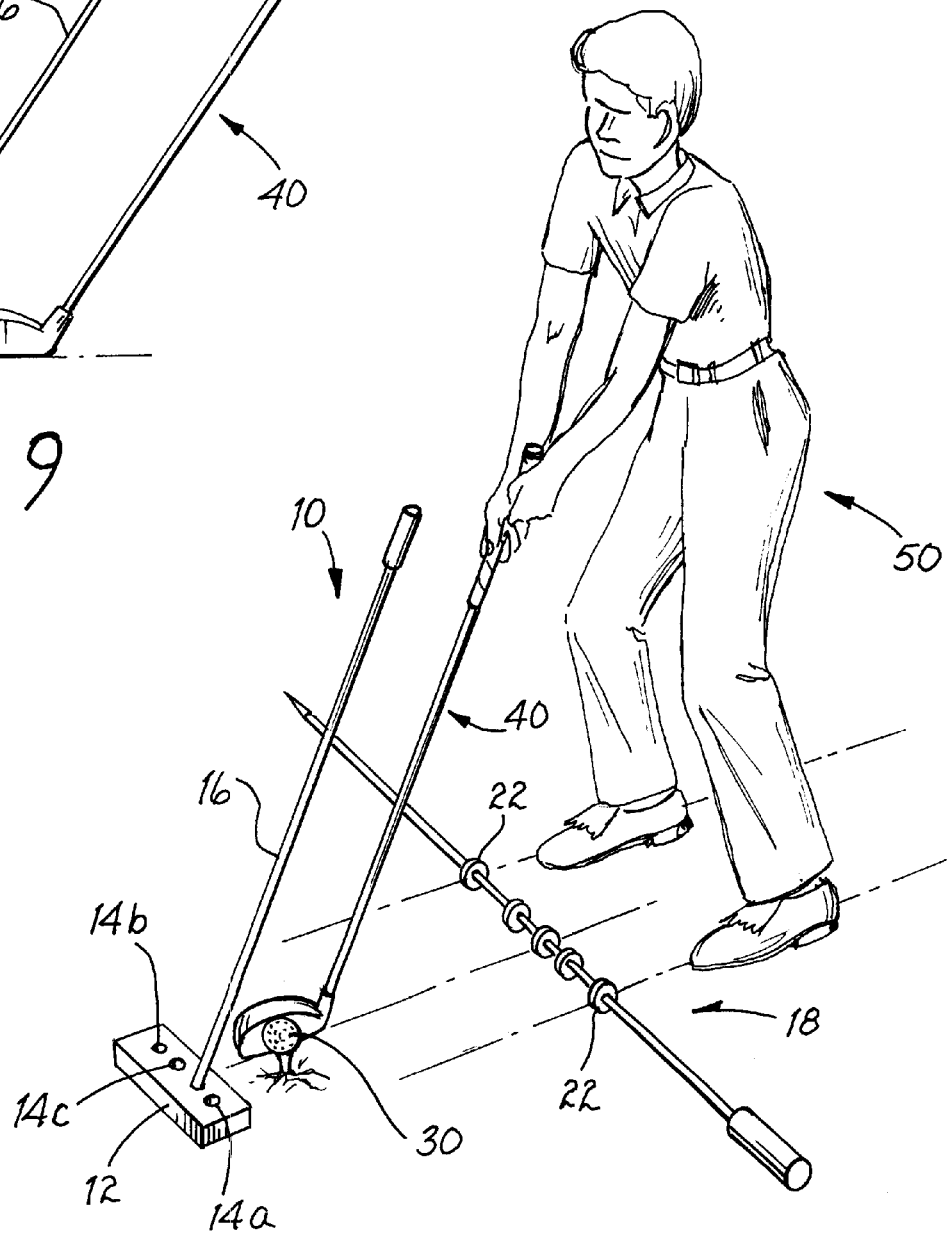
FIG. 8 is a perspective view of a person using the training device and method of the present invention.

Referring to FIG. 8, the golf swing training device ("training device") 10 of the present invention is shown in perspective view. FIGS. 1–7 illustrate the component portions of the training device 10. Thus, referring first to FIGS. 1–5, the template 12 is shown. As shown in FIG. 1, the template 12 is preferably rectangular-shaped, and has at least one angled opening 14 and preferably four angled openings 14. Referring to FIG. 6, a template shaft 16, having a pointed end 17, is shown, dimensioned to be inserted through any of the angled openings 14 in the manner illustrated in FIG. 8. Referring to FIG. 7, the alignment shaft 18, having a sharpened end 20, is shown. The alignment shaft 18 further preferably includes five collars that are positioned about the alignment shaft 18 in such manner that they may with the application of relatively minimal force (though not merely by tilting the alignment shaft 18 in one direction or another) be slid along the alignment shaft 18: two shoulder alignment collars 22 and three ball placement collars 24*a,* 24*b,* and 24*c*. Preferably, the five slidable collars are color-coded for identification purposes as desired, with, for example the two shoulder alignment collars 22 colored black, the ball placement collar 24*a* colored red, the ball placement collar 24*b* colored white, and the ball placement collar 24*c* colored blue.

The component portions of the training device 10 will now be addressed in more detail, in the context of describing the preferred use of the training device 10. In use, the golfer 50 will first position the alignment shaft 18 in front of his or her body, with the middle of the alignment shaft 18 preferably directly in front of the golfer 50's sternum, in the manner shown in FIG. 8. During positioning, the pointed end 20 of the alignment shaft 18 is aimed at the desired target and the alignment shaft 18 should be equidistant from each of the feet of the golfer 50. The golfer 50 should then adjust the position of the two black shoulder alignment collars 22 so that each is positioned at the outside, lateral portion of one of the golfer 50's shoulders. Through this positioning of the alignment shaft 18 and the shoulder alignment collars 22, the golfer 50 ensures proper alignment and balance.

With specific regard to the shoulder alignment collars 22, these can be relatively narrow as shown in FIGS. 7 and 8 and be dimensioned to indicate a single stance regardless of the particular club 40 used by the golfer 50, or the shoulder alignment collars 22 can be given a wider dimension, and can indicate thereon preferred stances depending on the particular club 40 used. In this regard, a golfer 50 using a longer club 40—such as a wood or long iron—will generally prefer a wider stance than a golfer 50 using a shorter club 40—such as a medium or short iron. Indeed, it is possible to provide a plurality of shoulder alignment collars 22, representing different stances for different clubs 40. Generally, a single set of shoulder alignment collars 22 as shown in FIGS. 7 and 8 will be sufficient for most beginning golfers 50, with more advanced golfers 50 perhaps requiring a plurality of stances.

The golfer 50 should next adjust the red ball positioning collar 24*a* until it is approximately two to four inches from the black shoulder alignment collar 22 most proximate the pointed end 20. (As an aid in accurate positioning, the alignment shaft 18 may be marked with ruler-type inch and/or centimeter markings, not shown.) The position of the red ball positioning collar 24*a* will be the desired placement for hitting woods or long irons, with the term "long irons" referring to irons from the one-iron to the four-iron. The golfer 50 should next adjust the white ball positioning collar 24*b* until it is approximately four to six inches from the black shoulder alignment collar 22 most proximate the pointed end 20. The position of the white ball positioning collar 24*b* will be the desired placement for hitting medium irons, with the term "medium irons" referring to irons from the five-iron to the eight-iron. The golfer 50 should next adjust the blue ball positioning collar 24*c* until it is approximately six to eight inches from the black shoulder alignment collar 22 most proximate the pointed end 20. The position of the blue ball positioning collar 24*c* will be the desired placement for hitting short irons, with the term "short irons" referring to irons from the nine-iron to the sand-wedge.

With specific regard to the ball positioning collars 24, these can be relatively narrow as shown in FIGS. 7 and 8 and be dimensioned to indicate a single location for the placement of a ball 30 regardless of the particular club 40 used by the golfer 50 within the range generally indicated by the particular ball positioning collar 24, or the ball positioning collars 24 can be given a wider dimension, and can indicate thereon preferred stances depending on the particular club 40 used—e.g, instead of a single ball positioning collar 24*b* indicating preferred ball 30 location for use of a medium iron, the ball positioning collar 24*b* could be made more wide, and could indicate thereon a particular location for the five iron, six iron, seven iron, and eight iron. In this regard, the longer the club 40 used, the farther back in the stance of the golfer 50 will be the preferred placement of the ball 30. It is also possible to provide an individual ball positioning collar 24 for each particular club, or at least to provide some number of ball positioning collars 24 that is greater than three, with for example each ball positioning collar 24 representing two clubs 40 rather than as many as four. Generally, a set of three relatively narrow ball positioning collars 24 as shown in FIGS. 7 and 8 will be sufficient for most beginning golfers 50, with more advanced golfers 50 perhaps requiring more specific ball 30 placement indication.

The next step is to place the template 12 on the ground, parallel to and preferably approximately two feet from the alignment shaft 18—as shown in FIG. 8. The template 12 has at least one and, as shown in FIG. 1, preferably four angled openings 14. These angled openings 14 preferably extend all of the way through the template 12, so that the template shaft 16 may be extended through the angled opening 14 until the pointed end 17 enters the ground below the template 12, retaining the template shaft 16 relatively firmly in position. The angles of the angled openings 14 correspond to that necessary to produce a desired swing plane. Preferably, the angles should be in the range of from about 47.5 degrees to about 57.5 degrees, though significant benefit may be obtained for certain golfers where the angle of the angled opening 14 is outside of this range on either side.

Preferably, a plurality of template shafts 16 are provided, having different lengths. In this regard, a golfer 50 using a longer-shafted club 40 will use a longer-length template shaft 16, while a golfer 50 using a shorter-shafted club 40 will use a shorter-length template shaft 16.

As shown in FIG. 1, in the preferred embodiment, the angled openings 14 preferably extend all of the way through the template 12, so that the pointed end 17 of the template shaft 16 may be inserted through the appropriate angled opening 14 and into the ground (not shown) below. However, the angled openings 14 may also be dimensioned so as to be closed at the bottom, for example where the training device 10 is to be used on an artificial surface. In this embodiment, the template shaft 12 need not have the pointed end 17, since the template shaft 12 will not need to be anchored into the ground (not shown) underlying the template 12.

In the preferred embodiment, the template 12 has four angled openings 14*a,* 14*b,* 14*c,* and 14*d,* wherein the angle of angled opening 14*a* is approximately 47.5 degrees, the angle of angled opening 14*b* is approximately 50 degrees, the angle of angled opening 14*c* is approximately 55 degrees, and the angle of angled opening 14*d* is approximately 57 degrees. Generally, the desired angle for the angled opening 14 will depend on the particular club 40 used as well as the height of the golfer 50—with the larger the club 40 used, the lower the desired angle of the angled opening 14, and vice versa. Preferably, a golfer 50 would use angled opening 14*a* for hitting a wood-type club, angled opening 14*b* for hitting long irons, angled opening 14*c* for hitting medium irons, and angled opening 14*d* for hitting short irons.

The template 12 shown in FIG. 8 is dimensioned to be used by a right-handed golfer 50, with the largest angled opening 14*a* positioned most forward in the template 12 and thus most forward in the stance of the golfer 50 when it is in position for use. However, the template 12 can also be configured for a left-handed golfer 50. In this embodiment, the angled openings 14 would be angled in the opposite direction, so as to again be in increasing order of angle size, with angled opening 14*a* most forward, followed by angled opening 14*b*, angled opening 14*c*, and angled opening 14*d*.

Figure 9:
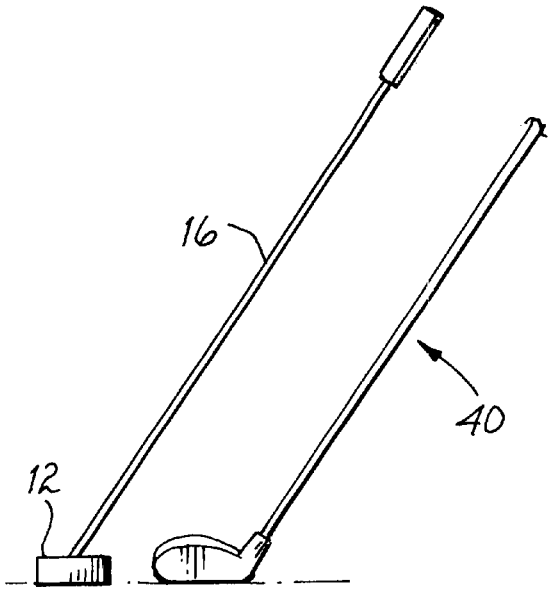
FIG. 9 is a side view showing the parallel relationship between a template shaft and club during set-up, as shown in FIG. 8.

Once the template 12 is in position, the golfer 50 selects a club 40, inserts the template shaft 16 into the desired angled opening 14, and places the ball 30 opposite the appropriate ball positioning collar 24—depending on the particular club 40 used—and approximately 4 to 6 inches from the template 12. The placement of the ball 30 opposite the appropriate ball positioning collar 24 ensures proper ball placement. The golfer 50 then positions the head of the club 40 behind the ball 30, taking care to maintain the club 40 in an angle relative to the ground that is equivalent to the angle of the template shaft 16—as shown in FIGS. 8 and 9—a process most easily accomplished by attempting to hold the club 40 in position parallel to the template shaft 16. The golfer 50 then starts his or her backswing, taking care to maintain the desired angle. The need to maintain the club 40 in proper position relative to the protruding template shaft 16 causes the golfer 50 to slow his or her backswing, helping the golfer 50 to develop better, slower swing tempo.

Repetitive use of the training device 10 in this manner should help the golfer 50 develop improved swing plane, alignment, balance, tempo and ball placement.

While the invention has been particularly shown and described with reference to preferred embodiments thereof, it will be understood by those skilled in the art that the foregoing and other changes in form and details may be made therein without departing from the spirit and scope of the invention. For example, while the template 12 and alignment shaft 18 have been described as separate, unconnected components of the training device 10, it would be possible to construct them in a manner in which they comprised a one-piece construction or at least two coupled components. For example, the alignment shaft 18 could be connected with one or more straps (not shown) to the template 12, so that the distance between the template 12 and alignment shaft 18 can be set with certainty when positioning the training device 10 for use.

What is claimed is:

1. A golf swing training device comprising, in combination:

an alignment shaft;

wherein said alignment shaft contains indicators showing the proper positioning of a user's shoulders for striking a golf ball;

wherein said alignment shaft further contains at least one indicator showing the proper positioning of said golf ball for striking;

a template dimensioned to be positioned parallel to said alignment shaft;

wherein said template comprises at least one opening therein at a desired club angle; and a template shaft dimensioned to be inserted into said opening and to extend in the direction of said user so as to permit said user to orient a golf club below and parallel said template shaft at said desired club angle and with a head of said golf club proximate said golf ball.

2. The golf swing training device of claim 1 wherein said angle of said opening in said template is at an angle in the range of from about 47.5 degrees to about 57.5 degrees.

3. The golf swing training device of claim 2 wherein said angle of said opening in said template is at an angle of approximately 47.5 degrees.

4. The golf swing training device of claim 2 wherein said angle of said opening in said template is at an angle of approximately 50 degrees.

5. The golf swing training device of claim 2 wherein said angle of said opening in said template is at an angle of approximately 55 degrees.

6. The golf swing training device of claim 2 wherein said angle of said opening in said template is at an angle of approximately 57.5 degrees.

7. The golf swing training device of claim 1 wherein said template comprises four said openings therein at a desired club angle.

8. The golf swing training device of claim 1 wherein said indicators showing the proper positioning of a user's shoulders for striking a golf ball and said at least one indicator showing the proper positioning of said golf ball for striking are differently colored.

9. The golf swing training device of claim 1 wherein said alignment shaft contains:

a first indicator showing the proper positioning of a golf ball for striking by a user swinging one of a wood and a long iron;

a second indicator showing the proper positioning of a golf ball for striking by a user swinging a medium iron; and a third indicator showing the proper positioning of a golf ball for striking by a user swinging a wedge-type iron.

10. The golf swing training device of claim 9 wherein each of said first indicator, said second indicator, and said third indicator is differently colored.

11. A method for improving a golf swing comprising the steps of:

providing an alignment shaft;

wherein said alignment shaft contains two shoulder position indicators showing the proper positioning of a user's shoulders for striking a golf ball;

wherein said alignment shaft further contains at least one golf ball position indicator showing the proper positioning of said golf ball for striking;

positioning said alignment shaft in front of said user so that said user is facing said alignment shaft and so that a lateral portion of each of the two shoulders of said user is located opposite one of said shoulder position indicators;

providing a template;

wherein said template comprises at least one opening therein at a desired club angle;

positioning said template parallel to said alignment shaft so that said user is located on one side of said alignment shaft and said template is located on another side of said alignment shaft;

providing a template shaft dimensioned to be inserted into said opening and to extend in the direction of said user so as to permit said user to orient a golf club below and parallel said template shaft at said desired club angle and with a head of said golf club proximate said golf ball;

inserting said template shaft into said opening;

positioning said golf ball proximate said golf ball position indicator;

positioning a head of said golf club proximate said golf ball so that a shaft of said golf club is at said desired club angle; and swinging said golf club so that said shaft passes below said template shaft while maintaining said desired club angle.

12. The method of claim 11 wherein said step of positioning said template parallel to said alignment shaft so that said user is located on one side of said alignment shaft and said template is located on another side of said alignment shaft further comprises the step of positioning said template approximately two feet from said alignment shaft.

13. The method of claim 11 wherein said angle of said opening in said template is at an angle in the range of from about 47.5 degrees to about 57.5 degrees.

14. The method of claim 13 wherein said angle of said opening in said template is at an angle of approximately 47.5 degrees.

15. The method of claim 13 wherein said angle of said opening in said template is at an angle of approximately 50 degrees.

16. The method of claim 13 wherein said angle of said opening in said template is at an angle of approximately 55 degrees.

17. The method of claim 13 wherein said angle of said opening in said template is at an angle of approximately 57.5 degrees.

18. The method of claim 11 wherein said template comprises four said openings therein at a desired club angle.

19. The method of claim 11 wherein said indicators showing the proper positioning of a user's feet for striking a golf ball and said at least one indicator showing the proper positioning of said golf ball for striking are differently colored.

20. The method of claim 11 wherein said alignment shaft contains:

a first indicator showing the proper positioning of a golf ball for striking by a user swinging one of a wood and a long iron;

a second indicator showing the proper positioning of a golf ball for striking by a user swinging a medium iron; and a third indicator showing the proper positioning of a golf ball for striking by a user swinging a wedge-type iron.

21. The method of claim 20 wherein each of said first indicator, said second indicator, and said third indicator is differently colored.

* * * * *